United States Patent [19]

Trocciola et al.

[11] Patent Number: 4,767,606

[45] Date of Patent: Aug. 30, 1988

[54] PROCESS AND APPARATUS FOR PRODUCING NITROGEN

[75] Inventors: John C. Trocciola, Glastonbury; Leslie L. VanDine, Manchester, both of Conn.

[73] Assignee: United Technologies Corporation, Hartford, Conn.

[21] Appl. No.: 930,827

[22] Filed: Nov. 14, 1986

[51] Int. Cl.[4] ..... C01B 21/04

[52] U.S. Cl. ..... 423/351; 423/219; 429/13; 429/17; 429/19; 55/68

[58] Field of Search ..... 423/219, 235, 351; 204/129; 429/13, 17, 19; 55/68

[56] References Cited

U.S. PATENT DOCUMENTS

| | | | |
|---|---|---|---|
| 2,314,827 | 3/1943 | Hortvet | 423/351 |
| 3,301,709 | 1/1967 | Lindström | 423/351 |
| 3,352,716 | 11/1967 | Lindström | 429/17 |
| 3,532,547 | 10/1970 | Vaaldieck | 429/17 |
| 3,616,334 | 10/1971 | Aker et al. | 204/129 |
| 3,979,225 | 9/1976 | Smith et al. | 429/17 |
| 4,131,514 | 12/1978 | Chong et al. | 204/129 |
| 4,548,799 | 10/1985 | Knoblauch et al. | 423/351 |
| 4,650,728 | 3/1987 | Matsumura et al. | 429/17 |
| 4,670,359 | 6/1987 | Beshty et al. | 429/17 |
| 4,696,871 | 9/1987 | Pinto | 429/19 |

*Primary Examiner*—Anthony McFarlane
*Attorney, Agent, or Firm*—Harry J. Gwinnell

[57] ABSTRACT

An efficient process for the production of nitrogen from air using a fuel cell to provide both electrical power and an oxygen depleted gas stream to a liquefaction apparatus is disclosed. An apparatus for the production of nitrogen incorporating a fuel cell is also disclosed.

1 Claim, 2 Drawing Sheets

PROCESS AND APPARATUS FOR PRODUCING NITROGEN

DESCRIPTION

1. Technical Field

The field of art to which this invention pertains is the production of nitrogen.

2. Background Art

Purified nitrogen is widely used for such purposes as a feedstock for chemical syntheses or as an inert atmosphere in a variety of processes.

Nitrogen and oxygen are produced from air by liquefaction of the air and fractionation of the liquid air into nitrogen and oxygen product streams. The process is energy intensive.

There are applications, such as secondary oil recovery, which demand large quantities of nitrogen but in which there is no need for the oxygen byproduct of the liquefaction process. One approach in such cases is to produce nitrogen and oxygen by air liquefaction, use the nitrogen so produced and simply discard the oxygen byproduct. Such an approach is inefficient in the sense that resources are expended to produce the oxygen waste product.

Another approach is to use an air stream to oxidize a hydrocarbon fuel in a combustion process to produce a stream of oxygen depleted gas. The combustion process produces heat and a stream of nitrogen, carbon dioxide and water as well as impurities in the form of sulfur compounds. The water may be removed by condensation and the carbon dioxide removed by means of a gas scrubber to produce a stream composed chiefly of nitrogen gas. In this case the expense associated with liquefying the unwanted oxygen is avoided. The combustion process is inefficient in the sense that the heat produced in the combustion reaction is lost to the atmosphere, and resources are expended to remove the carbon dioxide.

What is needed in this art is an efficient means of producing nitrogen in applications which demand large quantities of nitrogen but in which there is no demand for the oxygen byproduct of an air liquefaction process.

DISCLOSURE OF INVENTION

An energy efficient process for producing nitrogen is disclosed. Air is fed to a fuel cell. An oxygen depleted, nitrogen rich gas stream and electric power are produced by means of the fuel cell. The oxygen depleted, nitrogen rich gas stream is liquefied and the mixture of liquid nitrogen and oxygen is then fractionated to produce separate streams of nitrogen and oxygen.

Another aspect of the invention involves an energy efficient apparatus for the production of nitrogen, which comprises a series of flow connected elements, including a fuel cell, a liquefaction apparatus and a fractionating apparatus.

The process and apparatus of the present invention are energy efficient in the sense that the unwanted oxygen, which would otherwise consume energy in a liquefaction process, is removed prior to liquefaction of the gas stream and the removal process is used to generate electrical energy by means of a fuel cell power plant. The electrical energy produced by the fuel cell is more readily used than the thermal energy generated in a combustion process, and may be directly applied to partially satisfy the energy requirements of the subsequent liquefaction process. The process of the present invention, in contrast to the combustion process, produces a nitrogen stream that is not contaminated by oxides of sulfur or carbon.

The foregoing, and other features and advantages of the present invention will become more apparent from the following description and accompanying drawings.

BEST MODE FOR CARRYING OUT THE INVENTION

Figure 1:
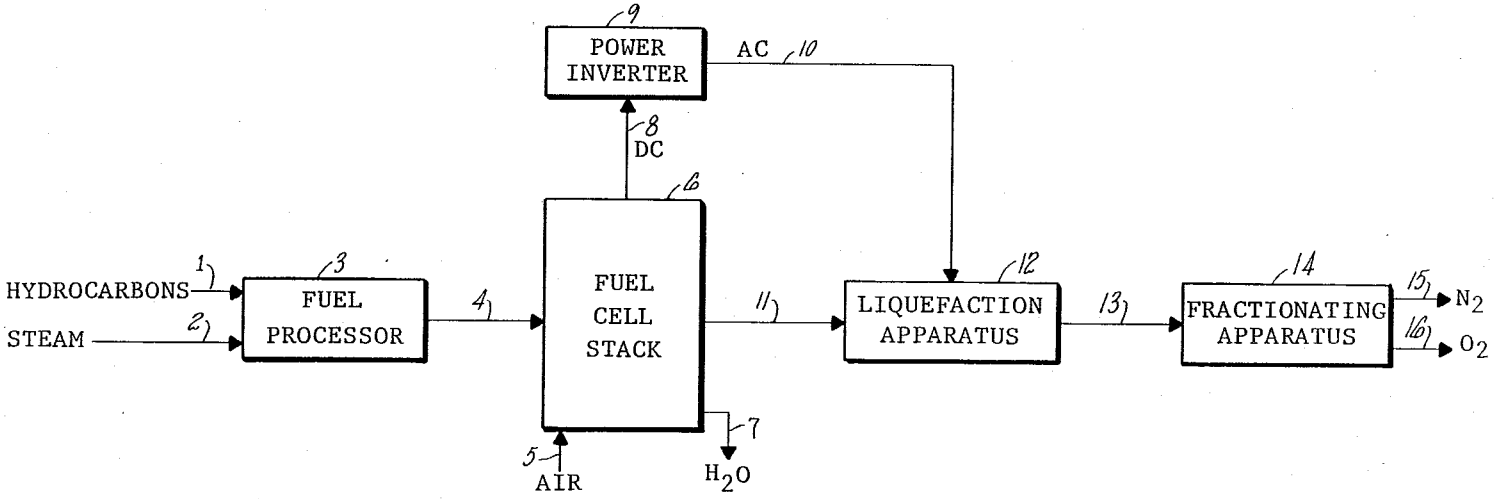
FIG. 1 is a schematic representation of the nitrogen production apparatus of the present invention, showing the relationship of the fuel cell power plant to the liquefaction apparatus.

The flow diagram of FIG. 1 schematically represents the combination of a fuel cell with the liquefaction and distillation apparatii.

The fuel processing unit (3) converts the hydrocarbon fuel (1) and steam (2) into a hydrogen rich gas (4).

The hydrogen rich gas (4) and air (5) are supplied to the fuel cell stack (6). The fuel cell stack (6) comprises a group of individual fuel cells.

Figure 2:
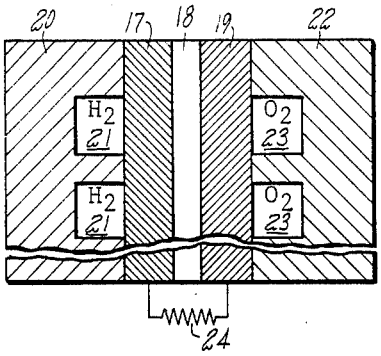
FIG. 2 is a cross sectional view of an exemplary fuel cell.

A cross sectional view of an exemplary individual fuel cell is presented in FIG. 2. An individual fuel cell is composed of two electrodes, a porous anode (17) and a porous cathode (19) that are separated from each other by an electrolyte layer (18) and separated from adjoining cells by separator plates (20) and (22). The anode (17) and cathode (19) are in electrical contact through an external circuit (24).

The hydrogen rich fuel is introduced to the anode (17) through channels (21) in the separator plate (20). Air is introduced to the cathode (19) through channels (23) in the separator plate (22). At the anode (17), the fuel is electrochemically oxidized to give up electrons, and the electrons are conducted through the external circuit (24) to the cathode (19), and electrochemically combined with the oxidant. The flow of electrons through the external circuit (24) balanced by a concurrent flow of ions through the electrolyte layer (18) from one electrode to the other. The ionic species involved and the direction of flow are dependent upon the type of fuel cell involved. For example, in an acid electrolyte fuel cell, hydrogen gas is catalytically decomposed at the anode (17) to give hydrogen ions and electrons according to the reaction $H_2 \rightarrow 2H^+ + 2e-$. The hydrogen ions are transported from the anode (17) through the electrolyte (18), to the cathode (19). The electrons flow from the anode (17) to the cathode (19) by means of the external circuit (24). At the cathode (19), oxygen is catalytically combined with the hydrogen ions and electrons to produce water according to the reaction $O_2 + 4H^+ + 4e- \rightarrow 2H_2O$. The water is condensed and comprises a byproduct stream (7), represented in FIG. 1. While the reactions typical of an acid electrolyte fuel cell are used as an example here, other types of cells, such as alkaline, molten carbonate or solid oxide electrolyte fuel cells may also be used with the present invention.

Operation of a fuel cell produces an oxygen depleted exhaust stream. The exhaust stream is correspondingly rich in nitrogen. For example, air contains about 0.20 mole fraction oxygen and about 0.80 mole fraction nitrogen. Typically, a fuel cell may be expected to consume about 80 percent of the oxygen in the influent air stream. The effluent gas stream from a typical fuel cell would then contain only about 0.04 mole fraction oxygen and about 0.96 mole fraction nitrogen. The oxygen depleted effluent gas stream from each of the individual cells are combined to form the effluent gas stream (11) from the fuel cell stack (6), each represented in FIG. 1.

The flow of electrons from the anode (17) to the cathode (19) through the external circuit (24) is the electrical energy produced by the cell. The external circuit (24) in FIG. 2 corresponds to the path of direct electrical current (8) from the fuel cell stack (6) to the power inverter (9) in FIG. 1. The power inverter (9) transforms the direct electrical current (8) into an alternating electrical current (10). The alternating current (10) is available as a source of electrical energy.

The number of individual fuel cells in the fuel cell stack (6) is determined by the volume of air that must be processed to provide sufficient volume of oxygen depleted, nitrogen rich gas (11) to the liquefaction apparatus (12), which is in turn determined by the desired nitrogen output (15) of the nitrogen production apparatus. The power output of the stack is the sum of the output of the individual fuel cells. A determination of the number of fuel cells in the stack, based on nitrogen production rate, also determines the electrical power output of the fuel cell stack (6).

The oxygen depleted, nitrogen rich gas stream (11) from the fuel cell stack (6) is introduced to its liquefaction apparatus (12).

Figure 3:
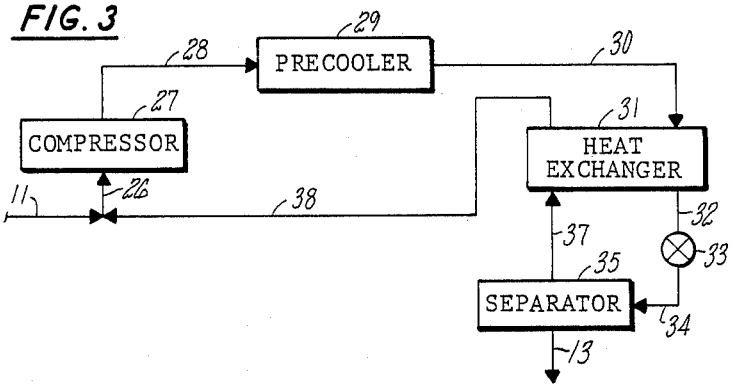
FIG. 3 is a schematic representation of an exemplary liquefaction apparatus.

A schematic representation of an exemplary liquefaction apparatus is presented in FIG. 3. The gas stream (11) is combined with a recycle gas stream (38) and the mixture (26) is introduced to a compressor (27). In the compressor (27), the gas is compressed to a high pressure, typically greater than 2000 psig. The compression is typically accomplished in several stages and the gas is cooled between each stage so that the gas stream (28) exiting the compressor (27) is at high pressure and moderate temperature, typically below 100° F. The temperature of the compressed gas stream (28) is reduced in the precooler (29). The stream (30) of cool compressed gas is introduced to a heat exchanger (31) wherein further cooling takes place. The temperature of the cold compressed gas (32) is reduced to a point where partial condensation to the liquid phase results by expansion in a throttling valve (33). The mixed stream (34) of gas and liquid is separated into the two respective phases in a single stage separator (35). The cold gas stream (37) is recirculated to provide cooling in the heat exchanger (31). The recirculated gas stream (38) leaving the heat exchanger is mixed with the incoming gas stream (11). The liquid stream (13) from the separator (35), comprising a mixture of liquid oxygen and liquid nitrogen, forms the feed (13) for the fractionating apparatus (14) in FIG. 1.

The feed stream (13) is separated to give a stream of nitrogen product (15) and a stream of oxygen byproduct (16) by means of at least one fractionating column. A series of columns may be required to obtain high purity product streams.

Figure 4:
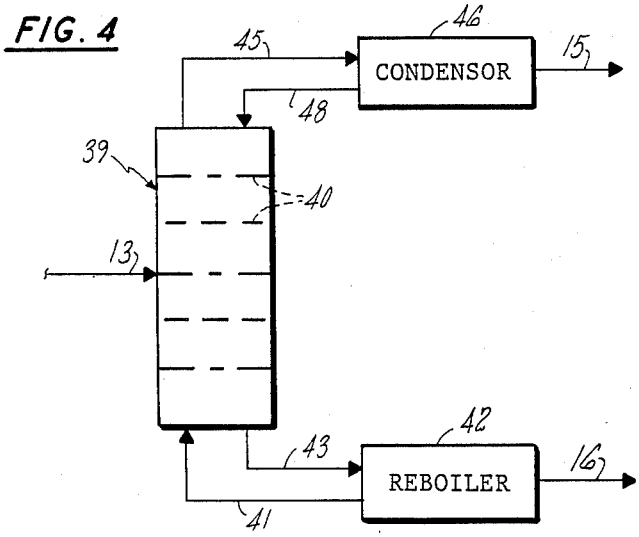
FIG. 4 is a schematic representation of an exemplary fractionating apparatus.

A schematic representation of an exemplary fractionating column is presented in FIG. 4. The liquid feed (13) is introduced to the fractionating column (39). The column (39) contains a number of zones separated by perforated plates (40). The liquid runs down the column to form a stream (43) entering the reboiler (42). In the reboiler (42) heat is applied to vaporize a portion of the remaining liquid. The vapor stream (41) exits the reboiler (42) and reenters the fractionating column (39). The stream of vapor rises up the column (39) to form a stream (45) entering the condensor (46) where the vapor is cooled and condensed to the liquid phase. A stream of liquid (48) is returned to the column (39). A countercurrent flow of liquid and vapor is thus established with liquid running down the column and vapor rising up the column in contact with the descending liquid. The liquid and vapor phases within each of the zones of the column approach equilibrium composition. The vapor phase becomes richer in the lower boiling component, here comprising nitrogen, as it approaches the top of the column. The liquid phase becomes richer in the higher boiling component, here comprising oxygen, as it approaches the bottom of the column. A portion of the nitrogen rich liquid is withdrawn from the condensor (46) as the nitrogen product stream (15). A portion of the oxygen rich liquid is withdrawn from the reboiler (42) as the oxygen byproduct stream (16).

The nitrogen production apparatus of the present invention features the coupling of a fuel cell powerplant with apparatus for gas liquefaction and fractionation. The nitrogen production process offers a unique advantage with respect to producing nitrogen from air, in that oxygen, which would consume energy in a conventional liquefaction apparatus, is removed prior to liquefaction, and in the removal process the oxygen is used to generate electrical energy. The electrical energy produced by the fuel cell may be applied to partially satisfy the energy requirements of the subsequent liquefaction process.

Although this invention has been shown and described with respect to detailed embodiments thereof, it will be understood by those skilled in the art that various changes in form and detail thereof may be made without departing from the spirit and scope of the claimed invention.

We claim:

1. A process for the production of nitrogen from air, comprising:

(a) feeding a gas consisting essentially of air to the cathode of a fuel cell, said fuel cell producing electrical energy, water and an oxygen depleted, nitrogen rich cathode exhaust stream, (b) feeding the oxygen depleted, nitrogen rich cathode exhaust stream to a gas liquefaction apparatus, said liquefaction apparatus producing a mixture of liquid nitrogen and liquid oxygen, (c) feeding the mixture of liquid nitrogen and liquid oxygen to a fractionating apparatus, said fractionating apparatus separating the mixture to produce a stream of nitrogen product and a stream of oxygen byproduct, such process resulting in enhanced energy efficiency in the production of nitrogen.

* * * * *

UNITED STATES PATENT AND TRADEMARK OFFICE

CERTIFICATE OF CORRECTION

PATENT NO. : 4,767,606

DATED : August 30, 1988

INVENTOR(S) : John C. Trocciola & Leslie L. VanDine

It is certified that error appears in the above-identified patent and that said Letters Patent is hereby corrected as shown below:

Title page:

"Assignee:" should be --International Fuel Cells Corporation, South Windsor, CT--

Signed and Sealed this

Twenty-first Day of March, 1989

*Attest:*

*Attesting Officer*

DONALD J. QUIGG

*Commissioner of Patents and Trademarks*